US007406864B1

(12) United States Patent
Sarshar et al.

(10) Patent No.: US 7,406,864 B1
(45) Date of Patent: Aug. 5, 2008

(54) METHOD FOR PREVENTION/DETECTION OF MECHANICAL OVERLOAD IN A RECIPROCATING GAS COMPRESSOR

(75) Inventors: Hamid Reza Sarshar, The Woodlands, TX (US); Vinh K. Do, Houston, TX (US); Simone Pratesi, Vicchio (IT); Nicola Campo, Florence (IT); Jeffrey Raynal, Houston, TX (US)

(73) Assignee: Nuovo Pignone Holdings, S.p.A., Florence (IT)

( * ) Notice: Subject to any disclaimer, the term of this patent is extended or adjusted under 35 U.S.C. 154(b) by 0 days.

(21) Appl. No.: 11/680,028

(22) Filed: Feb. 28, 2007

(51) Int. Cl.
*G01M 19/00* (2006.01)

(52) U.S. Cl. ..... 73/168
(58) Field of Classification Search ..... 73/168
See application file for complete search history.

(56) References Cited

U.S. PATENT DOCUMENTS

| | | | | |
|---|---|---|---|---|
| 2,964,235 | A * | 12/1960 | Welchon | 417/298 |
| 5,146,791 | A * | 9/1992 | Peter et al. | 73/862.49 |
| 5,214,932 | A * | 6/1993 | Abdelmalek | 62/238.4 |
| 5,836,567 | A * | 11/1998 | Watanabe | 251/129.12 |
| 6,540,481 | B2 | 4/2003 | Moussa et al. | |
| 6,794,766 | B2 | 9/2004 | Wickert et al. | |
| 6,969,239 | B2 | 11/2005 | Grant et al. | |
| 7,101,151 | B2 | 9/2006 | Loringer et al. | |

* cited by examiner

*Primary Examiner*—Andre J Allen
(74) *Attorney, Agent, or Firm*—Nixon & Vanderhye P.C.

(57) ABSTRACT

Mechanical overloads in a reciprocating gas compressor can cause irreparable damage to compressor components if the source of the overloads is not repaired. A method of detecting mechanical overloads includes forming a mechanical fuse that is configured to strain under overload conditions, and observing a condition of the mechanical fuse. The condition of the mechanical fuse is indicative of whether the compressor experienced a mechanical overload. By simply observing the mechanical fuse, overload conditions can be checked during routine inspections and maintenance checks.

9 Claims, 2 Drawing Sheets

METHOD FOR PREVENTION/DETECTION OF MECHANICAL OVERLOAD IN A RECIPROCATING GAS COMPRESSOR

BACKGROUND OF THE INVENTION

The invention relates to gas compressor maintenance and reliability and, more particularly, to a method for prevention/detection of mechanical overload in a reciprocating gas compressor.

An overload condition in a gas compressor can cause damage to compressor components that may affect operation and efficiency of the compressor. Repeated overload occurrences can compound damage to the compressor components, often beyond repair.

Currently, there is no ability beyond observing normal operation of the compressor to determine whether the compressor experienced an overload event. For example, excessive vibration during operation of the compressor provides evidence of a problem, which may have been caused by an overload condition after which the compressor can be shut down and inspected. At this point, however, equipment damage may be beyond repair.

It would thus be desirable to enable detection of an overload condition during routine maintenance and inspection of the compressor so that the problem or defect in the compressor components can be corrected before further damage is caused due to persistent overload events.

BRIEF DESCRIPTION OF THE INVENTION

In an exemplary embodiment of the invention, a method of detecting mechanical overload in a reciprocating gas compressor includes the steps of forming a mechanical fuse that is configured to strain under overload conditions, and observing a condition of the mechanical fuse, wherein the condition of the mechanical fuse is indicative of whether the compressor experienced a mechanical overload.

In another exemplary embodiment of the invention, a method of detecting mechanical overload in a reciprocating gas compressor includes the steps of: forming a mechanical fuse by making a relief cut in an outside diameter of a compressor piston rod, the mechanical fuse being configured to strain under overload conditions; applying a coating on the mechanical fuse, the coating having characteristics that cause a change in appearance under strain; and observing a condition of the coating on the mechanical fuse, wherein the condition of the coating is indicative of whether the compressor experienced a mechanical overload.

In still another exemplary embodiment of the invention, a method of preventing damage to components of a reciprocating gas compressor due to mechanical overload utilizes the method described above, and if a mechanical overload is detected, the method includes repairing the mechanical overload source before the compressor components are irreparably damaged.

DETAILED DESCRIPTION OF THE INVENTION

Gas compressors and systems are used to pressurize and circulate gas through a process, enhance conditions for chemical reactions, provide inert gas for safety or control systems, recover and recompress process gas, and maintain correct pressure levels by either adding and removing gas or vapors from a process system. Gas compressors work in multiple stages (up to four). In the first stage, gas flows through an inlet check valve and fills a larger diameter first-stage cylinder. A piston assembly is driven in one direction, compressing the gas in the first-stage cylinder. Gas in the first-stage cylinder flows through suitable valves into a smaller diameter second-stage cylinder.

At the end of the first stage, the piston assembly is driven in the other direction compressing gas in a second-stage cylinder. Further compression stages operate to further compress the gas, and after the last compression stage, gas flows out of the last-stage cylinder into a discharge gas line. The piston assembly reverses direction at the end of the stroke, and the cycle repeats.

There are four broad categories of compressor types. There are many variations within each type: reciprocating compressor, fan/blower compressors, rotary compressors, and ejector compressors.

Figure 1:
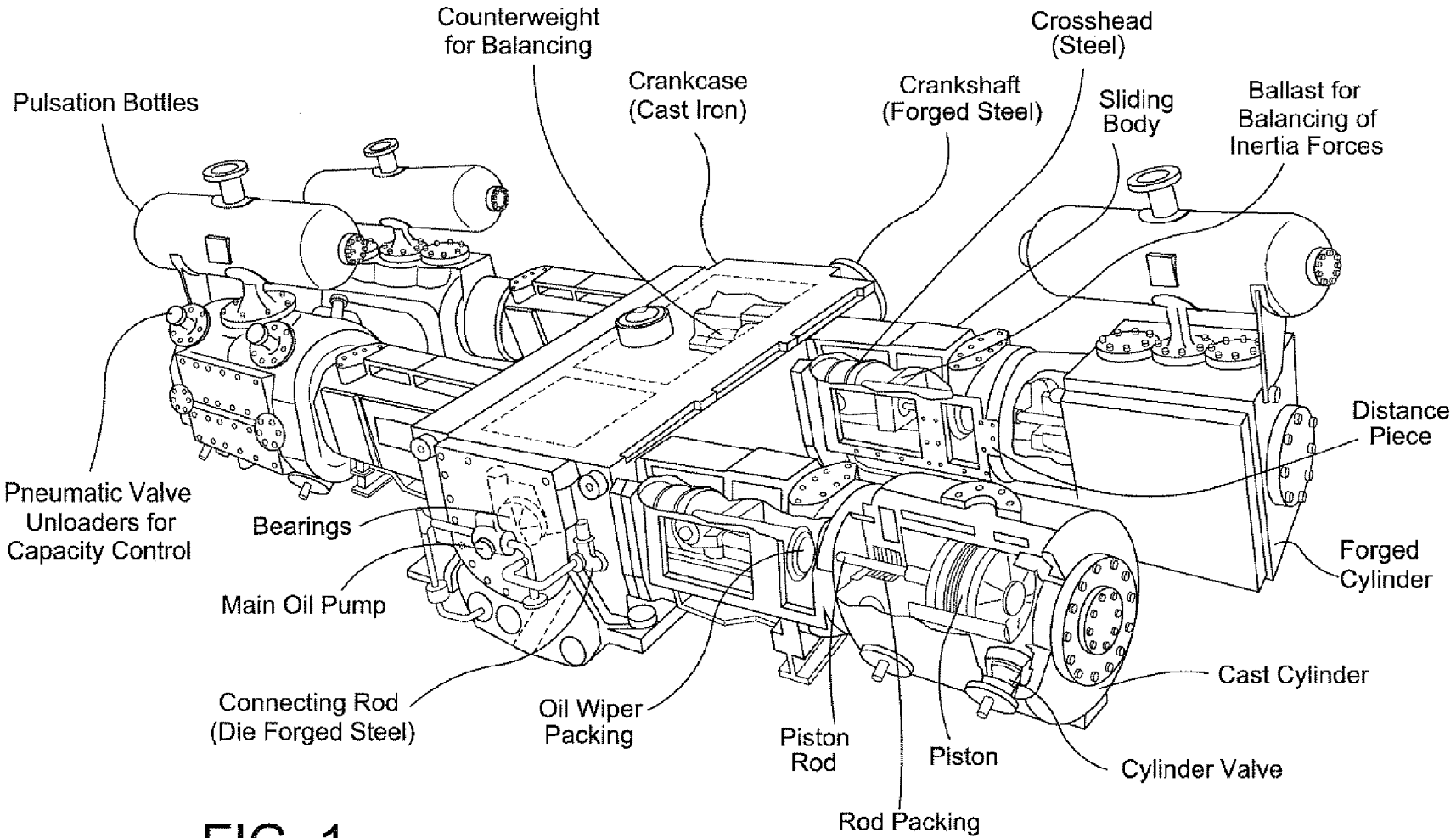
FIG. 1 illustrates a reciprocating gas compressor.

With reference to FIG. 1, in a reciprocating compressor, the thrust of a piston, within the cylinder, moves the gas through the system. This thrust enhances both the pressure and the density of the gas being transported. The main components of a reciprocating gas compressor are labeled in FIG. 1.

The reciprocating compressor is typically driven by a natural gas or diesel engine. The engine drives the crankshaft (rotational motion), and this rotational motion is converted to reciprocating motion through a series of components (connecting rod, crosshead, piston rod, piston assembly). Gas enters the cylinder body through suction valves (some cylinders have four valves while others have two valves), and the gas is compressed by the piston assembly through its reciprocating motion. After being compressed, the gas goes through the discharge valves and then onto the next stage of compression. The reciprocating compressor can be multi-staged up to four stages depending on flow, pressure, and horsepower requirements.

During normal operation, an overload event can occur when the compressor cylinder body ingests an incompressible material/object. The incompressible material/object can come in the form of a liquid (condensation, liquid carry-over) or a solid (broken valve pieces, parts of piston assembly, any foreign matter in the cylinder body). As discussed above, it would be desirable to detect the occurrence of a mechanical overload event within the compressor so that the cause of the overload can be corrected before irreparable damage is caused to the compressor components.

Figure 2:
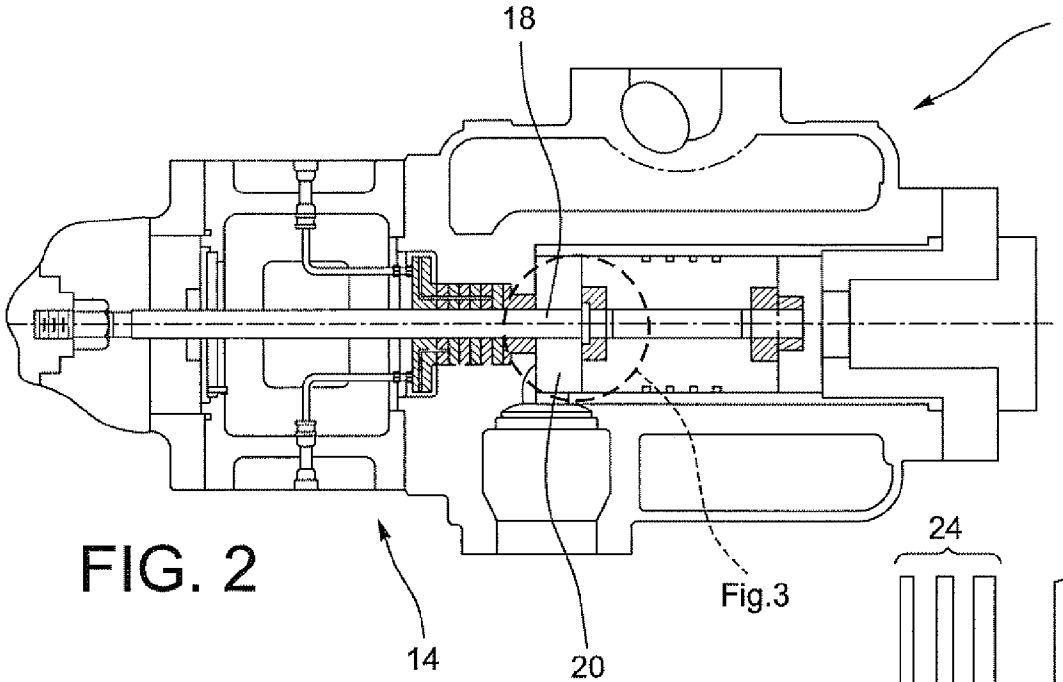
FIG. 2 is a cross-sectional view through the compressor cylinder.
Figure 3:
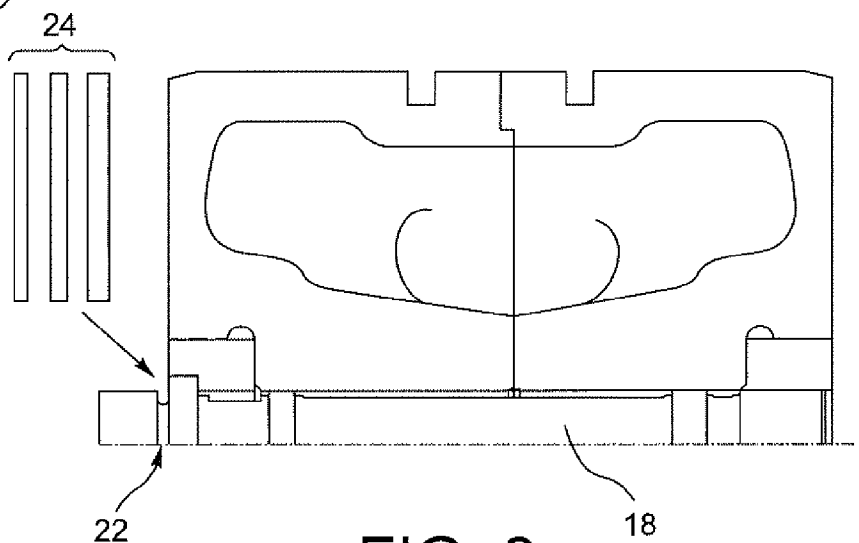
FIG. 3 is a close-up view of a portion identified in FIG. 2.

FIG. 2 is a cross-sectional view through the compressor cylinder 12. A crank end 14 of the cylinder and a head end 16 of the cylinder are shown. A piston rod 18 reciprocates a piston 20 in the cylinder 12. In order to detect an occurrence of mechanical overload, a mechanical fuse 22 is located on the piston rod 12 near the piston assembly in the cylinder 12. As shown in FIG. 3, the mechanical fuse 22 in a preferred construction is a simple relief cut on the outside diameter of the piston rod 18 that, when under tensile overloads, has the highest probability to fail or deform. Failure at this location will push the piston assembly to one side and allow the piston rod 18 to continue running, thus sealing the gases until the unit is shut down and serviced.

The mechanical fuse 22 is designed so that under overload conditions, it will strain prior to failing and provide a visual indication of an overload event. In one embodiment, a coating of suitable material is applied to the mechanical fuse 22, the coating having characteristics that cause a change in appearance under strain. The coating material may be colored to facilitate an observation of its condition. The coating may in fact be paint as a paint coating will crack or flake under strain.

In an alternative embodiment, a series of gauges 24 are used to measure the width of the fuse geometry to determine an amount of overload (strain) that has been imparted to the fuse. The gauge width is sized to correlate with an amount of overload incurred in the fuse 22.

In an event that the compressor experiences an overload, the method described herein can be used to prevent further damage to the compressor by providing indication during inspection or routine maintenance checks that an overload event had occurred. The method provides a simple, cost-effective approach to overload detection.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A method of detecting mechanical overload in a reciprocating gas compressor, the method comprising:

forming a mechanical fuse that is configured to strain under overload conditions by compromising a component of the gas compressor that upon failure or deformation will enable the gas compressor to continue operating; and observing a condition of the mechanical fuse, wherein the condition of the mechanical fuse is indicative of whether the compressor experienced a mechanical overload.

2. A method of detecting mechanical overload in a reciprocating gas compressor, the method comprising:

forming a mechanical fuse that is configured to strain under overload conditions; and observing a condition of the mechanical fuse, wherein the condition of the mechanical fuse is indicative of whether the compressor experienced a mechanical overload, wherein the forming step comprises applying a coating on the mechanical fuse, the coating having characteristics that cause a change in appearance under strain.

3. A method according to claim 2, wherein the coating is configured to crack or flake under strain, and wherein the observing step is practiced by visually inspecting the appearance of the mechanical fuse.

4. A method according to claim 1, wherein the observing step is practiced by measuring a geometric characteristic of the mechanical fuse, a change in the geometric characteristic being indicative of an overload event.

5. A method according to claim 4, wherein the measuring step is practiced by using a gauge to measure a width of the mechanical fuse, the width of the mechanical fuse being indicative of an amount of strain imparted on the mechanical fuse.

6. A method according to claim 5, wherein the measuring step is practiced by selecting from a series of gauges of different widths.

7. A method according to claim 1, wherein the forming step is practiced by making a relief cut in an outside diameter of a compressor piston rod, the mechanical fuse defining a safe failure point upon exceeding an overload limit.

8. A method of detecting mechanical overload in a reciprocating gas compressor, the method comprising:

forming a mechanical fuse by making a relief cut in an outside diameter of a compressor piston rod, the mechanical fuse being configured to strain under overload conditions;

applying a coating on the mechanical fuse, the coating having characteristics that cause a change in appearance under strain; and observing a condition of the coating on the mechanical fuse, wherein the condition of the coating is indicative of whether the compressor experienced a mechanical overload.

9. A method of preventing damage to components of a reciprocating gas compressor due to mechanical overload, the method comprising:

forming a mechanical fuse that is configured to strain under overload conditions by compromising a component of the gas compressor that upon failure or deformation will enable the gas compressor to continue operating;

observing a condition of the mechanical fuse, wherein the condition of the mechanical fuse is indicative of whether the compressor experienced a mechanical overload; and if a mechanical overload is detected, repairing the mechanical overload source before the compressor components are irreparably damaged.

* * * * *